US008590808B2

(12) United States Patent
Roach

(10) Patent No.: US 8,590,808 B2
(45) Date of Patent: Nov. 26, 2013

(54) APPARATUS AND METHOD FOR MOUNTING A SPRINKLER AT AN ELEVATED POSITION

(76) Inventor: Albert S. Roach, Stony Plain (CA)

( * ) Notice: Subject to any disclaimer, the term of this patent is extended or adjusted under 35 U.S.C. 154(b) by 936 days.

(21) Appl. No.: 12/330,613

(22) Filed: Dec. 9, 2008

(65) Prior Publication Data

US 2009/0184178 A1 Jul. 23, 2009

(30) Foreign Application Priority Data

Jan. 17, 2008 (CA) ..... 2618904

(51) Int. Cl.
*A62C 31/24* (2006.01)

(52) U.S. Cl.
USPC ..... 239/280; 239/280.5

(58) Field of Classification Search
USPC ..... 239/280, 273, 282, 283, 279, 200, 239/280.5, 281
See application file for complete search history.

(56) References Cited

U.S. PATENT DOCUMENTS 1,491,253 A * 4/1924 Barnes ..... 239/231
1,634,261 A * 7/1927 Knauff ..... 248/80
1,649,649 A * 11/1927 Bank ..... 248/84
1,780,308 A 11/1930 Morris
2,063,381 A * 12/1936 Holland ..... 239/280
2,795,459 A * 6/1957 Cornelius ..... 137/291
2,812,977 A * 11/1957 Phillips ..... 239/204
2,914,255 A * 11/1959 Jepson ..... 239/242
3,198,465 A 8/1965 Sutton
4,659,015 A * 4/1987 Rosenberg ..... 239/116
6,913,211 B2 * 7/2005 Chen ..... 239/532
7,303,146 B2 * 12/2007 Swingley ..... 239/203

* cited by examiner

*Primary Examiner* — Davis Hwu
(74) *Attorney, Agent, or Firm* — Dennis T. Griggs; Scott T. Griggs; Griggs Bergen LLP

(57) ABSTRACT

An apparatus and method for sprinkler mounting, the apparatus comprises a housing and a coupler, for coupling the sprinkler to the housing. The housing defines an interior chamber, a lower opening, and a receiver. The housing comprises a first sidewall, a second sidewall, a front wall, a back wall and a roof. The chamber can receive a first support end via the lower opening to mount the housing relative to a support. The housing thus mounted can be secured to the support via a fastener. Alternatively, the fastener can mount and secure the housing relative to the support with the housing's exterior contacting the support. The receiver, for receiving the fastener, comprises one or more of: an upwardly facing aperture in the roof; a front notch in the front wall; a back notch in the back wall; first aperture in the first sidewall; and second aperture in the second sidewall.

25 Claims, 7 Drawing Sheets

APPARATUS AND METHOD FOR MOUNTING A SPRINKLER AT AN ELEVATED POSITION

CROSS-REFERENCE TO FOREIGN PRIORITY APPLICATION

Priority is claimed under 35 U.S.C. §119 to Canadian Application No. 2,618,904 entitled "An Apparatus and Method for Mounting a Sprinkler at an Elevated Position," filed Jan. 17, 2008, by Albert S. Roach.

BACKGROUND OF THE INVENTION

1. Field of the Invention

The present disclosure is related to the field of sprinkler mounts, in particular, to an apparatus and method for removably mounting a sprinkler at an elevated position with respect to a foundation, wherein the apparatus can be removably mounted relative to a support and can removably receive a fastener.

2. Description of the Related Art

Prior art sprinkler mounts can generally be mounted and secured to a support in a limited number of ways and consequently are not suitable for certain field conditions. For instance, a sprinkler mount that cannot readily mount as sprinkler at an appropriate location relative to a target surface can lead to the inefficient use of the sprinkler in spraying target surfaces. Also, during fire-fighting, mounting the sprinkler too low relative to a target building can result in the sprinkler spraying water toward the target building at an angle, which can cause water damage to the target building.

There is a need for an apparatus for mounting a sprinkler that is adapted for use in a variety of field conditions, in that the apparatus can be easily mounted and secured in a variety of ways to a variety of different types of supports in order to maximize efficient use of the sprinkler in spraying target surfaces and/or to help prevent water damage to target buildings.

BRIEF SUMMARY OF THE INVENTION

An apparatus for mounting a sprinkler is provided. In one embodiment, the apparatus can removably mount a sprinkler at an elevated position with respect to a foundation, the apparatus can be removably mounted relative to a support and the apparatus can removably receive a fastener. The apparatus can comprise a housing and a coupler. The coupler can removably couple the housing to the sprinkler. The housing can have a front wall, a back wall, a roof, a first sidewall and a second sidewall. The housing can define an interior chamber and a lower opening to the interior chamber. The housing can define a receiver. The receiver can receive the fastener. The receiver can comprise one or more of the following: a first aperture formed by the first sidewall; a second aperture formed by the second sidewall; a front notch formed by the front wall extending into both the first sidewall and the second sidewall; a back notch formed by the back wall extending into both the first sidewall and the second sidewall; and an upwardly facing aperture formed by the roof. The housing and the coupling can be made of any suitable material. The fastener can be any suitable fastener.

The housing is mountable relative to the support in a variety of ways. The housing can be removably mounted relative to the support by the fastener when the fastener is received by the receiver. Alternatively, the housing can be removably mounted relative to the support by having the interior chamber receive a first support end of the support via the lower opening, so that the first support end can engage the interior of the housing to thereby support the housing on the support.

Furthermore, the housing can be removably secured to the support by the fastener when the fastener is received by the receiver.

A method is provided of removably mounting a sprinkler at an elevated position with respect to a foundation, using an apparatus that can be removably mounted relative to a support and that can removably receive a fastener. In one embodiment, the method comprises the following steps. The first step is providing the apparatus comprising a housing and a coupler. The coupler can removably couple the sprinkler to the housing. The housing comprises a front wall, a back wall, a roof, a first sidewall and a second sidewall. The housing can define an interior chamber, a lower opening to the interior chamber and a receiver. The receiver can receive the fastener. The second step is removably coupling the sprinkler to the housing via the coupler. The fastener can be any suitable fastener. The receiver can comprise one or more of the following: a first aperture formed by the first sidewall; a second aperture formed by the second sidewall; a front notch formed by the front wall extending into both the first sidewall and the second sidewall; a back notch formed by the back wall extending into both the first sidewall and the second sidewall; and an upwardly facing aperture formed by the roof. The third step is removably mounting the housing relative to the support by inserting the first end of the support into the interior chamber via the lower opening and engaging the first end of the support against the interior of the housing.

In another embodiment the third step is removably mounting the housing relative to said support using the fastener by inserting the fastener in the receiver.

In yet another embodiment, the method further comprising removably securing the housing to the support using the fastener by inserting the fastener in the receiver.

DETAILED DESCRIPTION OF THE INVENTION

Figure 1:
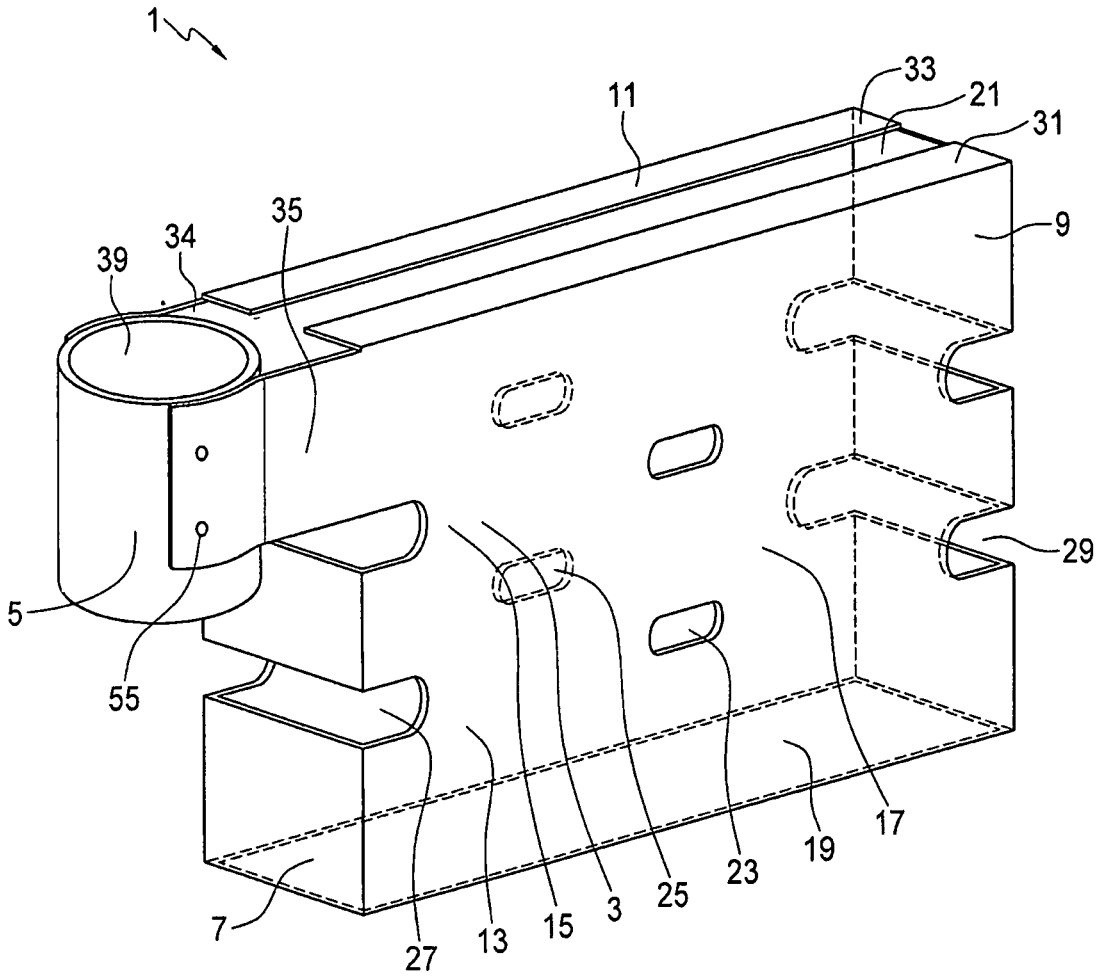
FIG. 1 is a perspective view depicting an apparatus for removably mounting a sprinkler comprising a housing and a coupler.
Figure 2:
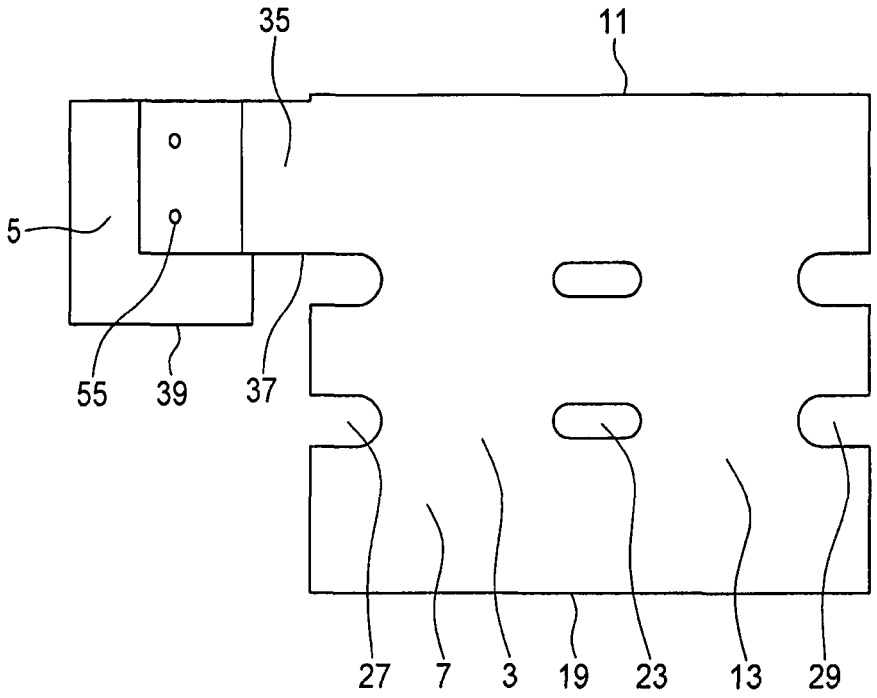
FIG. 2 depicts a side elevational view of the apparatus of FIG. 1.

FIGS. 1 and 2 show an embodiment of apparatus 1 for removably mounting a sprinkler 58 at an elevated position. Apparatus 1 comprises housing 3 and coupler 5. Housing 3 forms interior chamber 17 and lower opening 19 to interior chamber 17. Housing 3 comprises front wall 7, back wall 9, roof 11, first sidewall 13 and second sidewall 15. First sidewall 13 forms first aperture 23. Second sidewall 15 forms second aperture 25. In one embodiment, first aperture 23 is aligned with second aperture 25. Front wall 7 forms front notch 27, extending into both first sidewall 13 and second sidewall 15. Back wall 9 forms back notch 29, extending into both first sidewall 13 and second sidewall 15. In one embodiment, back notch 29 is aligned with front notch 27. Roof 11 defines upwardly facing aperture 21 and comprises first shelf 31 formed from first sidewall 13 and second shelf 33 formed from second sidewall 15. Apparatus 1 can be made of any suitable material. In one embodiment, apparatus 1 is made of metal.

In one embodiment, coupler 5 can be removably attached to the housing 3. In another embodiment, coupler 5 can be disposed on the housing. In the embodiment of FIGS. 1 and 2, coupler 5 is located adjacent front wall 7 and attached to the exterior of housing 3 via an extension 35 of first sidewall 13 and an extension 37 of second sidewall 15 using attaching means 55. Attaching means 55 can be any suitable attaching means. In one embodiment attaching means 55 comprise any one of screws, welds or crimping.

Coupler 5 can removably couple sprinkler 58 to housing 3. Any suitable sprinkler 58 may be attached to coupler 5. In one embodiment, coupler 5 can be removably attached to sprinkler 58 directly. In one embodiment, coupler 5 can be removably attached to sprinkler 58 or via a fitting. In one embodiment, coupler 5 is a ¾ inch coupling and a ¾ inch female hose fitting can be attached to the bottom of coupler 5 in order to connect a ¾ inch, ⅝ inch, or ½ inch hose to coupler 5. In one embodiment, coupler 5 forms channel 39 for fluid flow.

Figure 3:
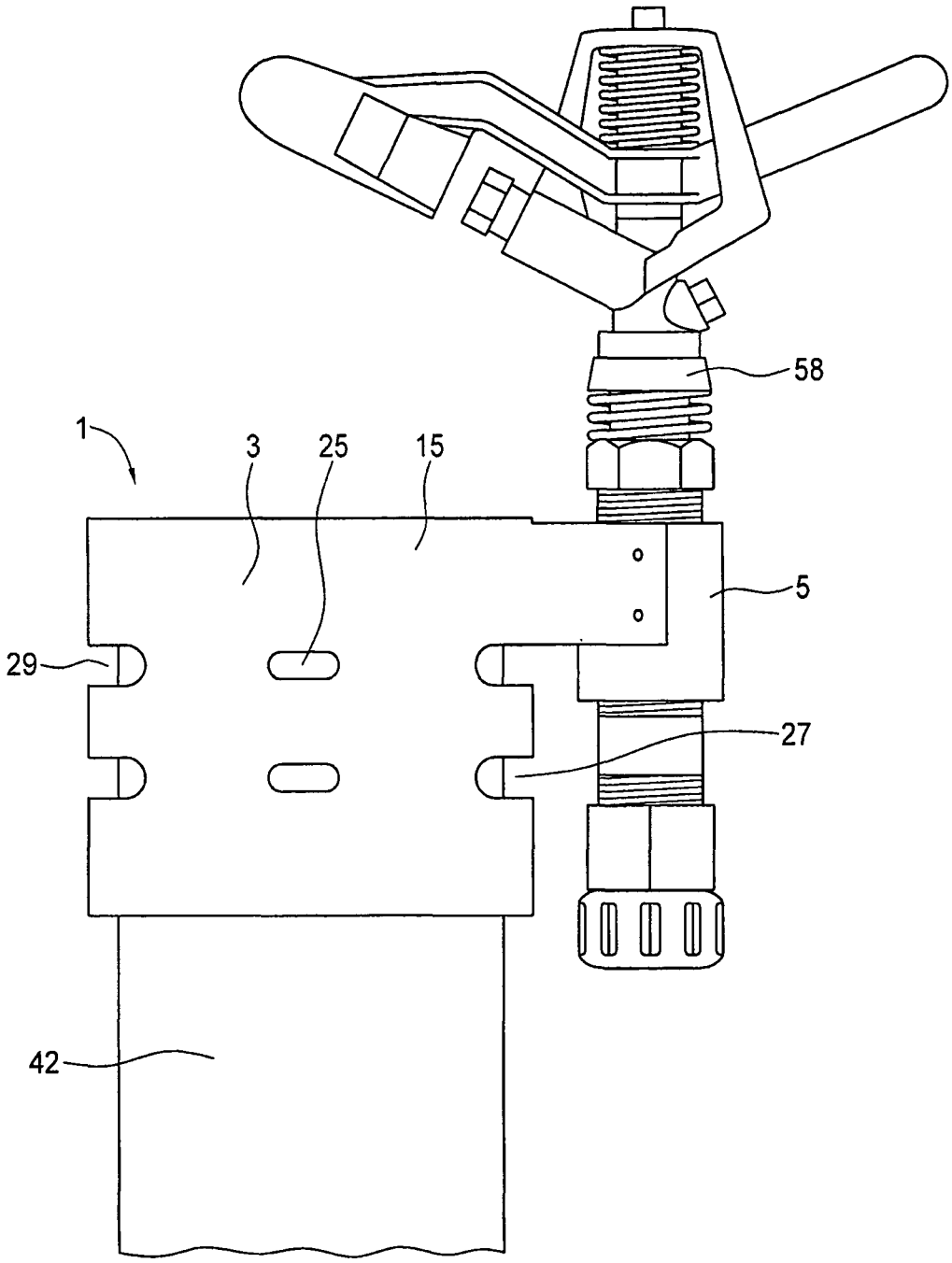
FIG. 3 depicts a side view of the apparatus of FIG. 1, mounted relative to a support with the first support end of a support received in an interior chamber formed by the housing and with the coupler coupling a sprinkler to the apparatus.

As shown in FIG. 3, apparatus 1 can be removably mounted relative to support 42, when first support end 45 of support 42 is received in interior chamber 17 via lower opening 19; so first support end 45 engages the interior of housing 3 to thereby support housing 3 on support 42. In the embodiment of FIG. 3, support 42 is a 2×4 piece of lumber and apparatus 1 is adapted to be mounted on said 2×4 piece of lumber. Specifically, in the embodiment of FIG. 3, housing 3 is dimensioned such that the first support end 45 of the 2×4 piece of lumber can be received in interior chamber 17 via lower opening 19, engage the interior of housing 3 and thereby support housing 3 on the 2×4 piece of lumber. As shown in FIG. 3, apparatus 1 can be mounted relative to support 42 without using fastener 5.

Figure 4:
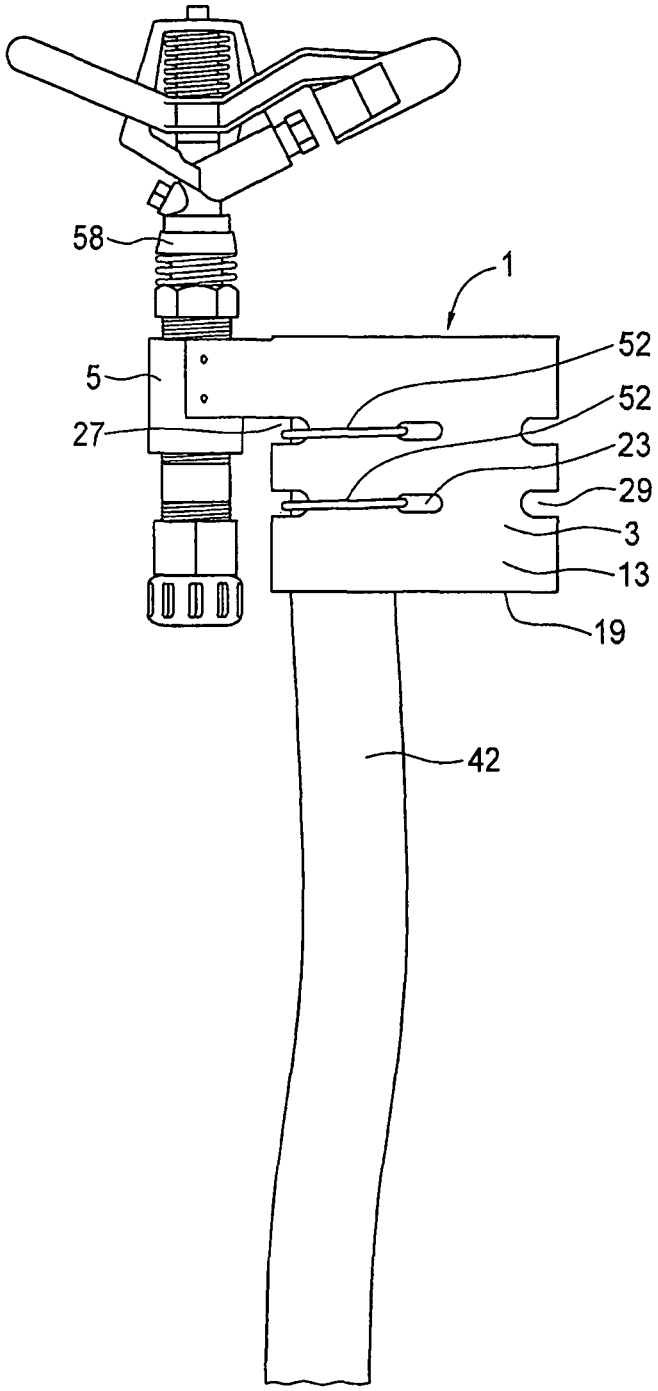
FIG. 4 depicts a side view of the apparatus of FIG. 1, mounted relative to a support with the first support end of a support received in an interior chamber formed by the housing, wherein the housing is further secured relative to the support by a fastener.

FIG. 4 shows apparatus 1 removably mounted relative to support 42, wherein first support end 45 of support 42 is received in interior chamber 17 via lower opening 19; engages the interior of housing 3 and thereby supports housing 3 on support 42. In FIG. 4, apparatus 1 thus mounted is secured to support 42 by fastener 52. In the embodiment of FIG. 4, front notch 27; first aperture 23 and second aperture 25 receive fastener 52, such that insertion of fastener 52 through front notch 27; first aperture 23 and second aperture 25 enables fastener 52 to contact both housing 3 and support 42 to thereby secure sprinkler mount 1 to support 42. In the embodiment of FIG. 4, fastener 52 is a wire. In another embodiment, fastener 52 can be any suitable fastener.

Figure 5:
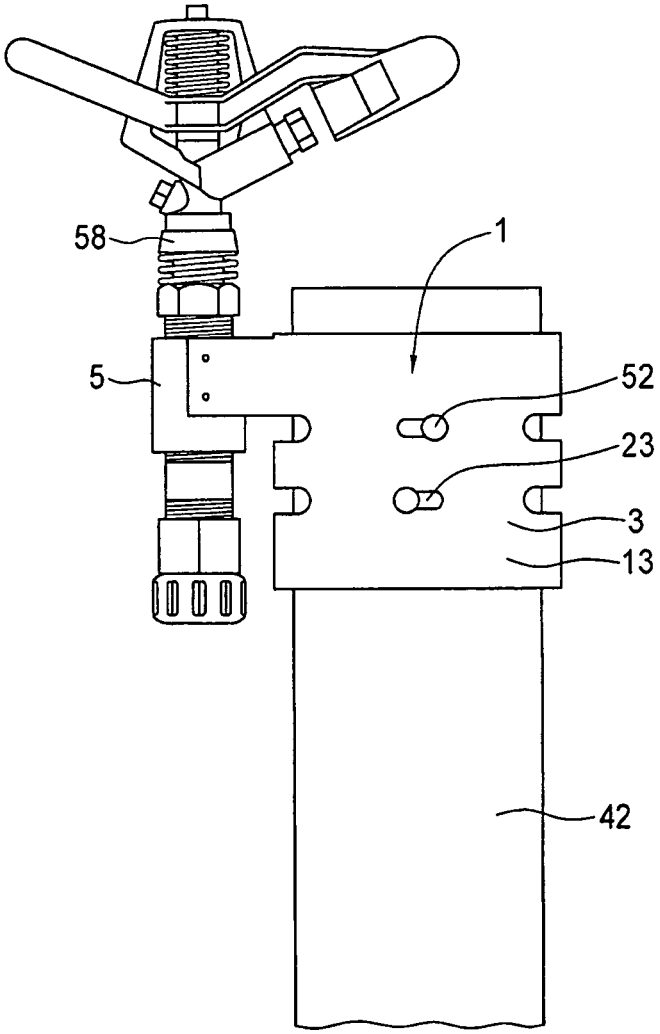
FIG. 5 depicts a side view of the apparatus of FIG. 1, mounted and secured relative to a support by a fastener.

As shown in FIG. 5, apparatus 1 can be mounted relative to support 42 by positioning the exterior of housing 3 in contact with support 42 and by both mounting and securing housing 3 to support 42 via fastener 52. In the embodiment of FIG. 5, first aperture 23 and second aperture 25 receive fastener 52, such that fastener 52 can be received by both first aperture 23 and second aperture 25 to both mount and secure housing 3 to support 42 by contacting both housing 3 and support 42. The embodiment of FIG. 5, fastener 52 is a nail or a screw. In another embodiment, fastener 52 can be any suitable fastener.

In other embodiments of apparatus 1, one or more of upwardly facing aperture 21; front notch 27; back notch 29; first aperture 23; and second aperture 25 can act as a receiver for removably receiving fastener 52.

Figure 6:
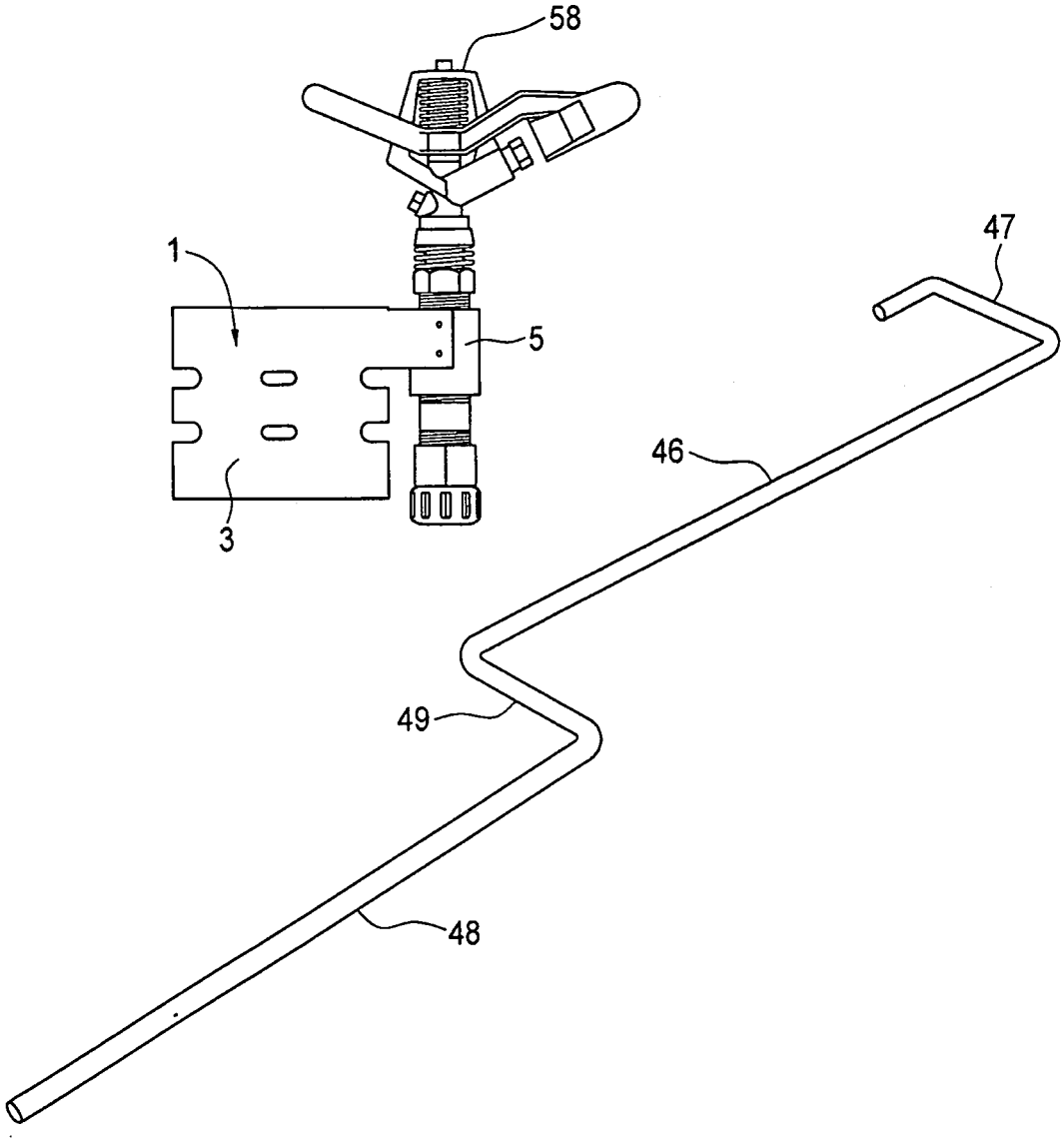
FIG. 6 depicts the apparatus of FIG. 1 further comprising a support leg.
Figure 7:
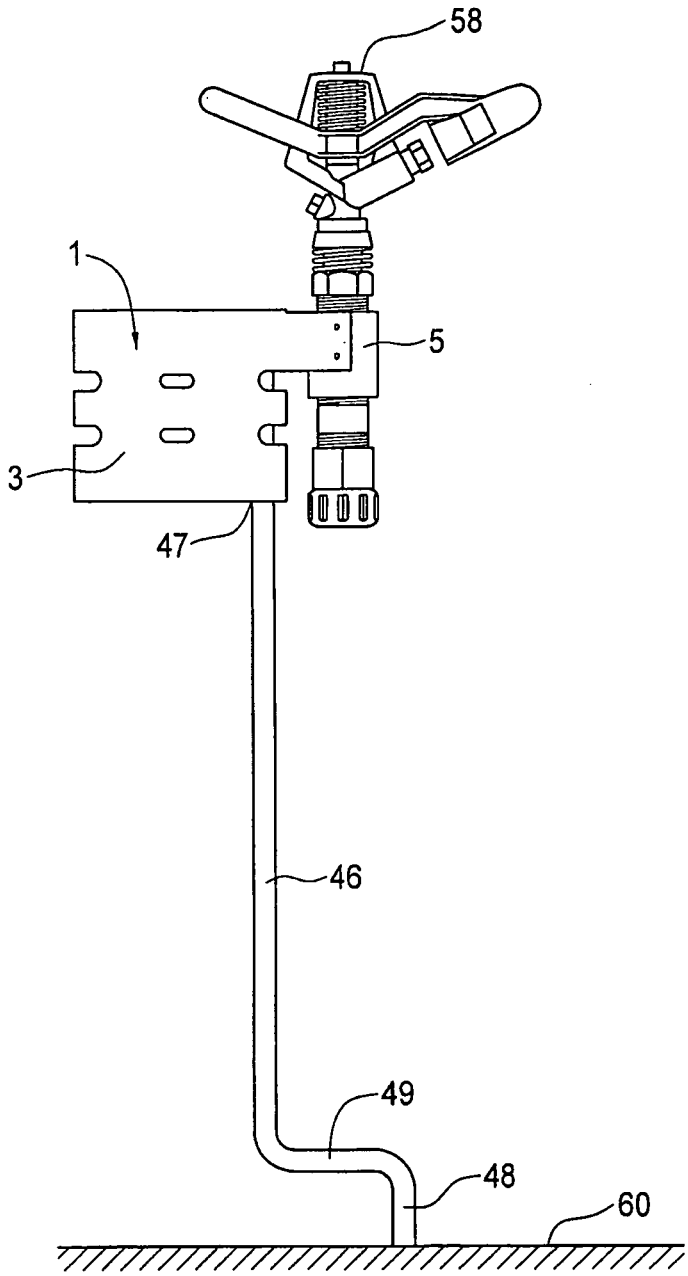
FIG. 7 depicts the apparatus of FIG. 1 mounted on the support leg of FIG. 6.

FIG. 6 shows apparatus 1 further comprising a support leg 46. Support leg 46 comprises upper end 47, lower end 48 and ground stop 49. As shown in FIG. 7, first upper end 47 can be removably received in interior chamber 17 via lower opening 19 and can engage the interior of housing 3 to thereby support housing 3 on support 42 while lower end 48 is removably attached to foundation 60. In other embodiments housing 3 is removably securable to support leg 46 by fastener 53 when fastener 52 is received by one or more of upwardly facing aperture 21, front notch 27, back notch 29, first aperture 23, and second aperture 25.

It will be noted that the present invention is one well adapted to attain all the ends and objects hereinabove set forth together with other advantages which are obvious and which are inherent to the disclosed process. Many embodiments may be made of the invention without departing from the scope thereof. Accordingly, it is to be understood that all matter herein set forth is to be interpreted as illustrative. Certain features and subcombinations that are of utility may be employed including substitutions, modifications, and optimizations, as would be available expedients to those of ordinary skill in the art.

I claim:

1. An apparatus for removably mounting a sprinkler at an elevated position with respect to a foundation, the apparatus can be removably mounted relative to a support and can removably receive a fastener, the apparatus comprising:

(a) a housing having a front wall a back wall, a roof, a first sidewall and a second sidewall, the housing defining an interior chamber, a lower opening to the interior chamber and a receiver for removably receiving the fastener, the receiver comprising at least one aperture disposed through one or both of the first and second sidewalls wherein the fastener can pass through the at least one aperture and fasten the apparatus to the support, the receiver further comprising one or both of a front notch formed by the front wall and a back notch formed by the back wall, each of the front and back notches extending into both of the first and second sidewalls; and (b) a coupler for removably coupling the sprinkler to the housing.

2. The apparatus as set forth in claim 1, wherein the housing can be removably mounted relative to the support by the fastener when the fastener is received by the receiver.

3. The apparatus as set forth in claim 1, wherein the interior chamber can receive a first support end of the support via the lower opening, so that the first support end can engage the interior of the housing to thereby support the housing on the support.

4. The apparatus as set forth in claim 1, wherein the housing can be secured to the support by the fastener when the fastener is received by the receiver.

5. The apparatus as set forth in claim 1, wherein the receiver comprises an upwardly facing aperture formed by the roof.

6. The apparatus as set forth in claim 1, wherein the roof comprises a first shelf formed by the first sidewall and a second shelf formed by the second sidewall.

7. The apparatus as set forth in claim 1, wherein the housing is adapted to be mounted on the support and the support comprises a 2×4 piece of lumber.

8. The apparatus as set forth in claim 1, wherein the coupler is disposed on the housing.

9. The apparatus as set forth in claim 1, wherein the coupler is attached to the exterior of the housing via an extension of the first sidewall and an extension of the second sidewall using an attaching means.

10. The apparatus as set forth in claim 1, wherein the coupler forms a channel for fluid flow.

11. The apparatus as set forth in claim 1, further comprising a support leg having:

(a) an upper end configured to be inserted into the interior chamber via the lower opening, to engage the interior of the housing and to thereby support the housing on the support leg; and (b) a lower end, configured to be inserted into the foundation.

12. The apparatus of claim 11, further comprising a ground stop on the support leg for abutting the foundation.

13. A method of removably mounting a sprinkler at an elevated position with respect to a foundation, using an apparatus that can be removably mounted relative to a support and that can removably receive a fastener, the method comprising:

(a) providing the apparatus comprising:

(i) a housing having a front wall, a back wall, a roof, a first sidewall and a second sidewall, the housing defining an interior chamber, a lower opening to the interior chamber and a receiver for removably receiving the fastener, the receiver comprising at least one aperture disposed through one or both of the first and second sidewalls wherein the fastener can pass through the at least one aperture and fasten the apparatus to the support, the receiver further comprising one or both of a front notch formed by the front wall and a back notch formed by the back wall, each of the front and back notches extending into both of the first and second sidewalls; and (ii) a coupler for removably coupling the sprinkler to the housing, wherein the coupler is attached to the exterior of the housing via one or both of an extension of the first sidewall and an extension of the second sidewall using an attaching means;

(b) removably coupling the sprinkler to the housing via the coupler; and (c) removably mounting the housing relative to said support by inserting the first end of the support into the interior chamber via the lower opening and engaging the first end of the support against the interior of the housing.

14. A method of removably mounting a sprinkler at an elevated position with respect to a foundation, using an apparatus that can be removably mounted relative to a support and that can removably receive a fastener, the method comprising:

(a) providing an apparatus comprising:

(i) a housing having a front wall, a back wall, a roof, a first sidewall and a second sidewall, the housing defining an interior chamber, a lower opening to the interior chamber and a receiver for removably receiving the fastener, the receiver comprising at least one aperture disposed through one or both of the first and second sidewalls wherein the fastener can pass through the at least one aperture and fasten the apparatus to the support, the receiver further comprising one or both of a front notch formed by the front wall and a back notch formed by the back wall, each of the front and back notches extending into both of the first and second sidewalls; and (ii) a coupler for removably coupling the sprinkler to the housing;

(b) removably coupling the sprinkler to the housing via the coupler; and (c) removably mounting the housing relative to said support.

15. The method as set forth in claim 13 further comprising removably securing the housing to the support using the fastener by inserting the fastener in the receiver.

16. The method as set forth in claim 14 further comprising removably securing the housing to the support using the fastener by inserting the fastener in the receiver.

17. An apparatus for removably mounting a sprinkler at an elevated position with respect to a foundation, the apparatus can be removably mounted relative to a support and can removably receive a fastener, the apparatus comprising:

(a) a housing having a front wall a back wall, a roof, a first sidewall and a second sidewall, the housing defining an interior chamber, a lower opening to the interior chamber and a receiver for removably receiving the fastener, the receiver comprising at least one aperture disposed through one or both of the first and second sidewalls wherein the fastener can pass through the at least one aperture and fasten the apparatus to the support, the receiver further comprising one or both of a front notch formed by the front wall and a back notch formed by the back wall, each of the front and back notches extending into both of the first and second sidewalls; and (b) a coupler for removably coupling the sprinkler to the housing, wherein the coupler is attached to the exterior of the housing via one or both of an extension of the first sidewall and an extension of the second sidewall using an attaching means.

18. The apparatus as set forth in claim 17, wherein the housing can be removably mounted relative to the support by the fastener when the fastener is received by the receiver.

19. The apparatus as set forth in claim 17, wherein the interior chamber can receive a first support end of the support via the lower opening, so that the first support end can engage the interior of the housing to thereby support the housing on the support.

20. The apparatus as set forth in claim 17, wherein the housing can be secured to the support by the fastener when the fastener is received by the receiver.

21. The apparatus as set forth in claim 17, wherein the receiver comprises an upwardly facing aperture formed by the roof.

22. The apparatus as set forth in claim 17, wherein the roof comprises a first shelf formed by the first sidewall and a second shelf formed by the second sidewall.

23. The apparatus as set forth in claim 17, wherein the housing is adapted to be mounted on the support and the support comprises a 2×4 piece of lumber.

24. The apparatus as set forth in claim 17, further comprising a support leg having:

(a) an upper end configured to be inserted into the interior chamber via the lower opening, to engage the interior of the housing and to thereby support the housing on the support leg; and (b) a lower end, configured to be inserted into the foundation.

25. The apparatus of claim 24, further comprising a ground stop on the support leg for abutting the foundation.

* * * * *